US009057245B2

(12) United States Patent
Wassell

(10) Patent No.: US 9,057,245 B2
(45) Date of Patent: Jun. 16, 2015

(54) METHODS FOR OPTIMIZING AND MONITORING UNDERGROUND DRILLING

(75) Inventor: Mark Ellsworth Wassell, Houston, TX (US)

(73) Assignee: APS Technology, Inc., Wallingford, CT (US)

( * ) Notice: Subject to any disclaimer, the term of this patent is extended or adjusted under 35 U.S.C. 154(b) by 0 days.

(21) Appl. No.: 13/283,518

(22) Filed: Oct. 27, 2011

(65) Prior Publication Data

US 2013/0105221 A1 May 2, 2013

(51) Int. Cl.
*E21B 47/00* (2012.01)
*E21B 44/00* (2006.01)
*E21B 44/04* (2006.01)

(52) U.S. Cl.
CPC ..... *E21B 44/00* (2013.01); *E21B 44/04* (2013.01)

(58) Field of Classification Search
CPC ..... E21B 7/00; E21B 44/00
See application file for complete search history.

(56) References Cited

U.S. PATENT DOCUMENTS

| | | | | |
|---|---|---|---|---|
| 6,547,016 | B2 | 4/2003 | Wassell | |
| 6,714,138 | B1 | 3/2004 | Turner | |
| 7,172,037 | B2 | 2/2007 | Dashevskiy et al. | |
| 7,243,735 | B2 | 7/2007 | Koederitz et al. | |
| 7,251,590 | B2 | 7/2007 | Huang et al. | |
| 7,327,634 | B2 | 2/2008 | Perry | |
| 7,681,663 | B2 | 3/2010 | Cobern | |
| 7,857,047 | B2 * | 12/2010 | Remmert et al. | 166/250.01 |
| 7,896,105 | B2 | 3/2011 | Dupriest | |
| 7,938,197 | B2 | 5/2011 | Boone | |
| 2006/0215491 | A1 | 9/2006 | Hall | |
| 2006/0260843 | A1 | 11/2006 | Cobern | |
| 2008/0156531 | A1 * | 7/2008 | Boone et al. | 175/27 |
| 2010/0214121 | A1 | 8/2010 | Puro | |
| 2011/0024188 | A1 | 2/2011 | Wassell | |
| 2011/0186353 | A1 | 8/2011 | Turner | |

FOREIGN PATENT DOCUMENTS

WO WO 2011017627 A1 * 2/2011

OTHER PUBLICATIONS

International Patent Application No. PCT/US2012/062022: International Search Report dated Jan. 25, 2013, 2 pages.

Dupriest, F., "Maximizing Drill Rates With Real-Time Surveillance of Mechanical Specific Energy," SPE/IADC Drilling Conference, SPE/IADC 92194 (2005), 10 pgs.

Koederitz, W., "A Real-Time Implementation of MSE," American Association of Drilling Engineers, AADE-05-NTCE-66 (2005), 7 pgs.

(Continued)

*Primary Examiner* — Jennifer H Gay
*Assistant Examiner* — Caroline Butcher
(74) *Attorney, Agent, or Firm* — Baker & Hostetler LLP

(57) ABSTRACT

A method of optimizing underground drilling in which the Specific Energy, such as the Mechanical Specific Energy, is determined at a plurality of weight on bits and drill bit rotary speeds. The drilling operation is optimized by drilling at the operating conditions, including weight on bit and drill bit rotary speed, at which the standard deviation in Mechanical Specific Energy is a minimum. The drilling operation is monitored by determining the Mechanical Specific Energy and changing the operating parameters if the standard deviation in the Mechanical Specific Energy exceeds a predetermined value.

13 Claims, 5 Drawing Sheets

(56) References Cited

OTHER PUBLICATIONS

Mohan, K., Tracking Drilling Efficiency Using Hydro-Mechanical Specific Energy, SPE/IADC Drilling Conference, SPE/IADC 119421 (2009), 12 pgs.

Teale, R., "The Concept of Specific Energy in Rock Drilling," Int. J. Rock Mech. Mining Sci., vol. 2, Pergamon Press, Great Britain,1965, pp. 57-73.

* cited by examiner

METHODS FOR OPTIMIZING AND MONITORING UNDERGROUND DRILLING

FIELD OF THE INVENTION

The present invention relates to underground drilling, and more specifically to methods for optimizing and monitoring such a drilling operation.

BACKGROUND OF THE INVENTION AND RELATED ART

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface to the bottom of the bore.

The drill bit is rotated so that the drill bit advances into the earth, thereby forming the bore. In rotary drilling, the drill bit is rotated by rotating the drill string at the surface. Piston-operated pumps on the surface pump high-pressure fluid, referred to as "drilling mud," through an internal passage in the drill string and out through the drill bit. The drilling mud lubricates the drill bit, and flushes cuttings from the path of the drill bit. In the case of motor drilling, the flowing mud also powers a drilling motor, commonly referred to as a "mud motor," which turns the bit, whether or not the drill string is rotating. The mud motor is equipped with a rotor that generates a torque in response to the passage of the drilling mud therethrough. The rotor is coupled to the drill bit so that the torque is transferred to the drill bit, causing the drill bit to rotate. The drilling mud then flows to the surface through an annular passage formed between the drill string and the surface of the bore.

Typically, measurements are taken of various operating parameters during drilling. For example, surface equipment senses the rate of penetration of the drill bit into the formation, the rotational speed of the drill string, the hook load, surface torque, and pressure. Sensors either at the surface or in a bottom hole assembly, or both, measure the axial tensile/compression load, torque and bending. However, selecting the values of the drilling parameters that will result in optimum drilling is a difficult task. For example, although reducing the downhole force applied to the drill bit, commonly referred to as the "weight on bit" ("WOB") or the rotary speed of the drill bit may reduce vibration, and thereby extend the life of drill string components, it may also reduce the rate of penetration ("ROP"). In general, optimal drilling is obtained when the rate of penetration of the drill bit into the formation is as high as possible while the vibration is as low as possible. The ROP is a function of a number of variables, including the rotational speed of the drill bit and the WOB.

Techniques have been developed to estimate the energy expended to drill through a fixed volume of rock—in other words, the ratio of the energy input into the drilling to the output of the drilling in terms of ROP—which is referred to as the Specific Energy. One measure of the Specific Energy is the Mechanical Specific Energy ("MSE"), which is a measure of the mechanical energy required to drill through a fixed volume of formation, obtained by determining the ratio of the rate of the mechanical energy usage to the ROP. More recently, another measure of the specific energy, referred to as the Hydro Mechanical Specific Energy ("HMSE") has been developed to take into account the hydraulic, as well as the mechanical, energy expended during drilling. Attempts have been made in the prior art to utilize the specific energy, especially the MSE, to optimize drilling performance by favoring operation at conditions that will result in a low value of MSE. However, depending on the characteristics of the drilling operation, operating a minimum value of MSE does not uniformly result in maximizing drilling performance. Therefore, an ongoing need therefore exists for methods of optimizing drilling performance and monitoring the drilling performance on an on-going basis to determine whether drilling conditions have changed, warranting further optimization.

SUMMARY OF THE INVENTION

In one embodiment, the invention encompasses a method, which may be computer implemented, of operating a drill string drilling into an earthen formation so as to form a bore hole using a drill bit, comprising the steps of: (a) operating the drill string at a plurality of different sets of drilling conditions during which the drill bit penetrates into the earthen formation by applying torque to the drill bit so as to rotate the drill bit and applying weight to the drill bit, wherein in a preferred embodiment each of the drilling conditions comprises the weight on the drill bit and the speed at which the drill bit rotates, the operation of the drill string being performed for a period of time at each of the sets of drilling conditions; (b) determining the combination of the torque applied to the drill bit and the rate at which the drill bit penetrates into the earthen formation a selected number of times over each of the periods of time at which the drilling is performed at each of the sets of drilling conditions; (c) determining the value of ratio of the energy input into the drilling to the output in terms of ROP, and preferably the Specific Energy, and most preferably the Mechanical Specific Energy, from each of the combinations of torque and rate of penetration determined in step (b) for each of the sets of drilling conditions; (d) determining the variability, such as by calculating the standard deviation, in the values of the ratio determined in step (c) for each of the sets of drilling conditions; (e) identifying the set of drilling conditions among the plurality of sets of drilling conditions for which the variability in the ratio is determined in step (d) that yielded the smallest variability; and (f) operating the drilling string at the set of drilling conditions identified in step (e).

The invention also encompasses a method of operating a drill string drilling into an earthen formation so as to form a bore hole using a drill bit, comprising the steps of: (a) operating the drill string at a first set of drilling conditions during which the drill bit penetrates into the earthen formation by applying torque to the drill bit so as to rotate the drill bit and applying weight to the drill bit, wherein the first set of drilling conditions comprises the weight on the drill bit and the speed at which the drill bit rotates; (b) determining the combination of the torque applied to the drill bit and the rate at which the drill bit penetrates into the earthen formation a selected number of times while operating at the first set of drilling conditions; (c) determining the ratio of the energy input into the drilling to the output of the drilling in terms of ROP, and preferably the value of the Specific Energy, and most preferably the value of Mechanical Specific Energy, from each of the combinations of torque and rates of penetration determined in step (b); (d) determining the variability in the values of the ratio determined in step (c); (e) determining whether the standard deviation in the values of ratios determined in step (d) exceeds a predetermined threshold; (f) changing from the first set of drilling conditions to a second set of drilling conditions if the variability in the values of ratio determined in step (d) exceeds the predetermined threshold.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show embodiments that are presently preferred. The invention is not limited, however, to the specific instrumentalities disclosed in the drawings.

DESCRIPTION OF PREFERRED EMBODIMENTS

Figure 1:
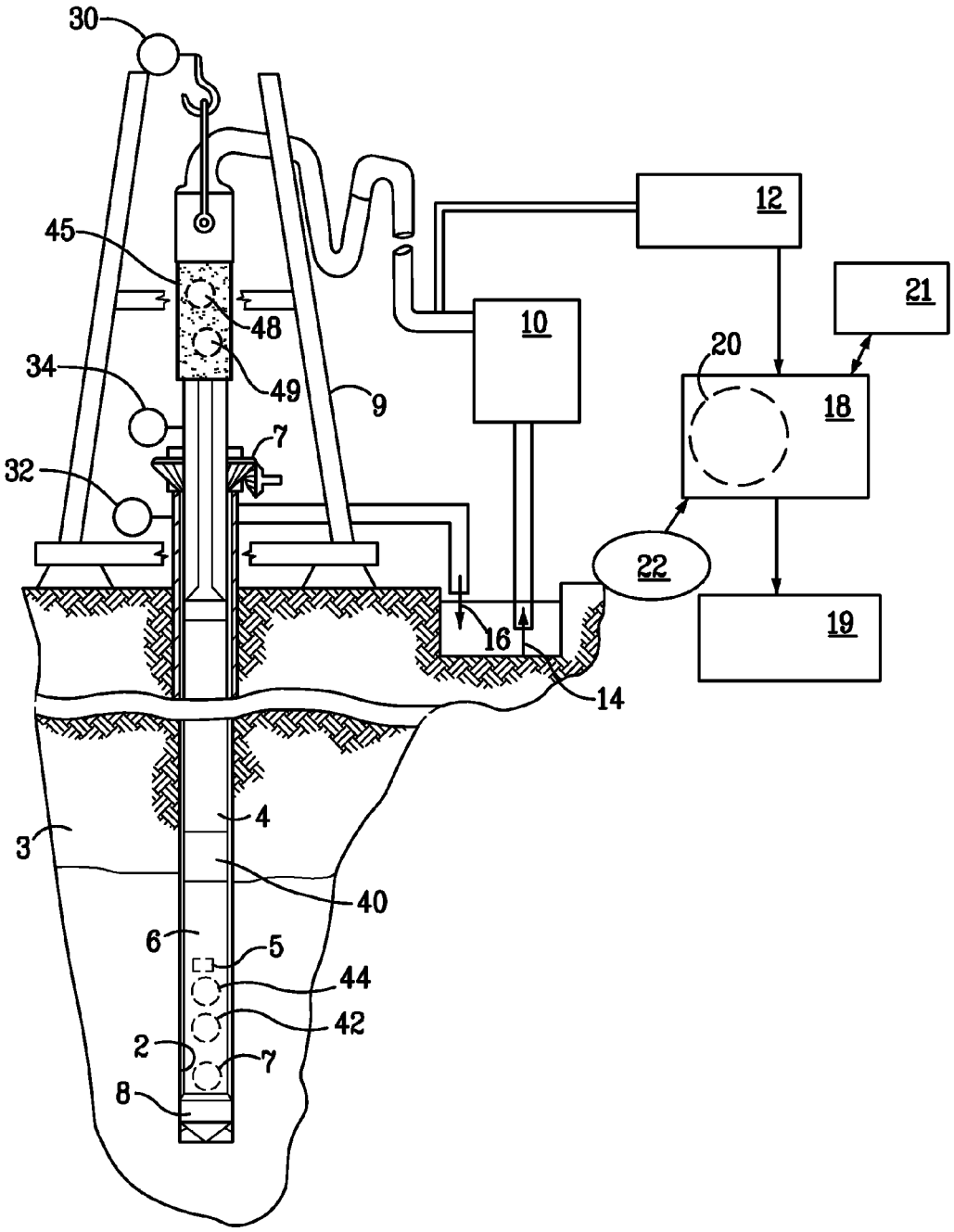
FIG. 1 is a view, partly schematic, of a drilling rig operated according to the current invention.

As shown in FIG. 1, drill rigs typically comprise a derrick 9 that supports a drill string 4. A drill bit 8 is coupled to the distal end of a bottomhole assembly 6 of the drill string 4. A prime mover (not shown), such as a top drive or rotary table, rotates the drill string 4 so as to control the rotational speed ("RPM") of, and torque on, the drill bit 8. As is conventional, a pump 10 pumps a fluid 14—typically referred to as drilling mud—downward through an internal passage in the drill string. After exiting at the drill bit 8, the returning drilling mud 16 flows upward to the surface through an annular passage formed between the drill string 4 and the bore hole 2 in the earthen formation 3. A mud motor 40, such as a helicoidal positive-displacement pump—sometimes referred to as a "Moineau-type" pump—may be incorporated into the bottomhole assembly 6 and is driven by the flow of drilling mud 14 through the pump.

According to the current invention, the values of WOB, drill bit RPM, ROP and torque on bit ("TOB") are determined and varied. Instrumentation and methods for determining WOB, RPM, ROP, TOB are described in U.S. application Ser. No. 12/698,125, filed Feb. 1, 2010, entitled "System and Method for Monitoring and Controlling Underground Drilling," hereby incorporated by reference in its entitery. Although various methods and instrumentation are described below for obtaining such values, other methods and instrumentation could also be utilizes.

Downhole strain gauges 7 may be incorporated into the bottomhole assembly 6 to measure the WOB. A system for measuring WOB using downhole strain gauges is described in U.S. Pat. No. 6,547,016, entitled "Apparatus For Measuring Weight And Torque An A Drill Bit Operating In A Well," hereby incorporated by reference herein in its entirety. In addition to downhole sensors measuring the WOB, downhole sensors, such as strain gauges, measuring the torque on bit ("TOB") and the bending on bit ("BOB") are also included in the bottomhole assembly. Techniques for downhole measurement of TOB are also described in the aforementioned U.S. Pat. No. 6,547,016, incorporated by reference above. Techniques for the downhole measurement of BOB are described in U.S. application Ser. No. 12/512,740, filed Jul. 30, 2009, entitled "Apparatus for Measuring Bending on a Drill Bit Operating in a Well," hereby incorporated by reference in its entirety. A sub incorporating WOB, TOB and BOB sensors is referred to as a "WTB sub."

A magnetometer 42 is incorporated into the bottomhole assembly 6 that measures the instantaneous rotational speed of the drill bit 8, using, for example, the techniques in U.S. Patent Application Publication No. 2006/0260843, filed May 1, 2006, entitled "Methods And Systems For Determining Angular Orientation Of A Drill String," hereby incorporated by reference herein in its entirety.

As is conventional, the WOB is controlled by varying the hook load on the derrick 9. A top sub 45 is incorporated at the top of the drill string and encloses strain gauges 48 that measure the axial (hook) load, as well as the bending and torsional load on the top sub, as is a triaxial accelerometer 49 that senses vibration of the drill string. Using techniques well known in the art, the WOB can be calculated from the hook load measured by the strain gauges in the top sub, for example, by subtracting the frictional resistance acting on the drill string from the measured hook load. The value of the frictional resistance can be obtained by pulling up on the drill string so that the drill bit is no longer contacting the formation and noting the change in the hook load. In a wired pipe, the data from the downhole sensors would be received by the top sub 45. The data from the top sub 45 strain gauges, as well as the downhole sensors in a wired pipe system, can be transmitted via wireless telemetry to the surface acquisition system 12, using the technique disclosed in U.S. application Ser. No. 12/389,950, filed Feb. 20, 2009, entitled "Synchronized Telemetry From A Rotating Element," hereby incorporated by reference in its entirety, so that certain parameters, such as WOB, can be determined at the surface.

Preferably, the surface monitoring system also includes a hook load sensor 30 for determining WOB. The hook load sensor 30 measures the hanging weight of the drill string, for example, by measuring the tension in the draw works cable using a strain gauge. The cable is run through three supports. The supports put a known lateral displacement on the cable. The strain gauge measures the amount of lateral strain due to the tension in the cable, which is then used to calculate the axial load. A sensor 32 is also used for sensing drill string rotational speed.

The drilling operation according to the current invention also includes a mud pulse telemetry system, which includes a mud pulser 5 incorporated into the downhole assembly 6. Using techniques well known in the art, the mud pulse telemetry system encodes data from downhole sensors and, using the pulser 5, transmits the coded pulses to the surface. Mud pulse telemetry systems are described more fully in U.S. Pat. No. 6,714,138, entitled "Method And Apparatus For Transmitting Information To The Surface From A Drill String Down Hole In A Well," U.S. Pat. No. 7,327,634, entitled "Rotary Pulser For Transmitting Information To The Surface From A Drill String Down Hole In A Well," and U.S. Patent Application Publication No. 2006/0215491, entitled "System And Method For Transmitting Information Through A Fluid Medium," each of which is incorporated by reference herein in its entirety.

As is also conventional, a data acquisition system 12 at the surface senses pressure pulsations in the drilling mud 14 created by the mud pulser 5 that contain encoded information from a vibration memory module and other sensors in the bottomhole assembly 6. The data acquisition system 12 decodes this information and transmits it to a computer processor 18, also preferably located at the surface. Data from the surface sensors, such as the hook load sensor 30, the drill string rotational speed sensor 32, and a ROP sensor 34 are also transmitted to the processor 18.

Software 20 for performing the methods described herein, discussed below, is preferably stored on a non-transitory computer readable medium, such as a CD, and installed into the processor 18 that executes the software so as to perform the methods and functions discussed below. The processor 18 is preferably connected to a display 19, such as a computer display, for providing information to the drill rig operator. A data entry device 22, such as a keyboard, is also connected to the processor 18 to allow data to be entered for use by the software 20. A memory device 21 is in communication with the processor 18 so that the software can send data to, and receive data from, storage when performing its functions. The processor 18 may be a personal computer that preferably has at least a 16× CD-ROM drive, 512 MB RAM, 225 MB of free disk space, a graphics card and monitor capable of 1024×786 or better at 256 colors and running a Windows XPTM operating system. Although the processor 18 executing the software 20 of the current invention is preferably located at the surface and can be accessed by operating personnel, portions of the software 20 could also be installed into a processor located in the bottomhole assembly so that some of the operations discussed below could be performed downhole.

According to the current invention, the Specific Energy is used to determine the most effective set of drilling parameters, in particular the optimum WOB and drill bit RPM. Preferably, the MSE is used as a measure of the Specific Energy. The MSE can be calculated, for example, as described in F. Dupriest & W. Koederitz, "Maximizing Drill Rates With Real-Time Surveillance of Mechanical Specific Energy," SPE/IADC Drilling Conference, SPE/IADC 92194 (2005) and W. Koederitz & J. Weis, "A Real-Time Implementation Of MSE," American Association of Drilling Engineers, AADE-05-NTCE-66 (2005), each of which is hereby incorporated by reference in its entirety. Specifically, the MSE may be calculated from the equation:

$$\mathrm{MSE}=[(480\times\mathrm{TOB}\times\mathrm{RPM})/(D^2\times\mathrm{ROP})]+[(4\times\mathrm{WOB})/(D^2\times\pi)]$$

Where:

MSE=Mechanical Specific Energy
TOB=torque applied to the drill bit, ft-lb
RPM=rotational speed of the drill bit
ROP=rate of penetration, ft/hr
WOB=weight on bit, lb
D=diameter of drill bit, inches Alternatively, the HMSE may be used. The HMSE can be calculated, for example, as described in K. Mohan & F. Adil, "Tracking Drilling Efficiency Using Hydro-Mechanical Specific Energy, SPE/IADC Drilling Conference, SPE/IADC 119421 (2009), herein incorporated by reference in its entirety. Specifically, the HMSE may be calculated from the equation:

$$\mathrm{HMSE}=[(\mathrm{WOB}-\acute{\eta}\times F_j)/A_b]+[(120\pi\times\mathrm{RPM}\times\mathrm{TOB}+1154\acute{\eta}\times\Delta P_b\times Q)/(A_b\times\mathrm{ROP})]$$

Where:

HMSE=Hydro Mechanical Specific Energy
TOB=torque applied to the drill bit, ft-lb
RPM=rotational speed of the drill bit
ROP=rate of penetration, ft/hr
WOB=weight on bit, lb
$A_b$=area of the drill bit, inches$^2$
$F_j$=impact force exerted by the fluid on the formation, lb
Q=Flow rate, gallons/minute
$\acute{\eta}$ dummy factor for energy reduction
$\Delta P_b$=pressure drop across the bit, psi According to conventional thinking, drilling should be conducted at the operating conditions that yield the lowest value of Specific Energy. However, surprisingly, the inventor has discovered that optimal drilling occurs at the operating conditions at which the scatter in the value of Specific Energy over time is a minimum, which are not necessarily the same operating conditions as those that yield the lowest value of Specific Energy.

The scatter in the values of Specific Energy over time may be quantified by, for example calculating the standard deviation in Specific Energy. The operating conditions that may be varied to determine optimum drilling may be, for example, drill bit RPM and WOB.

Figure 2:
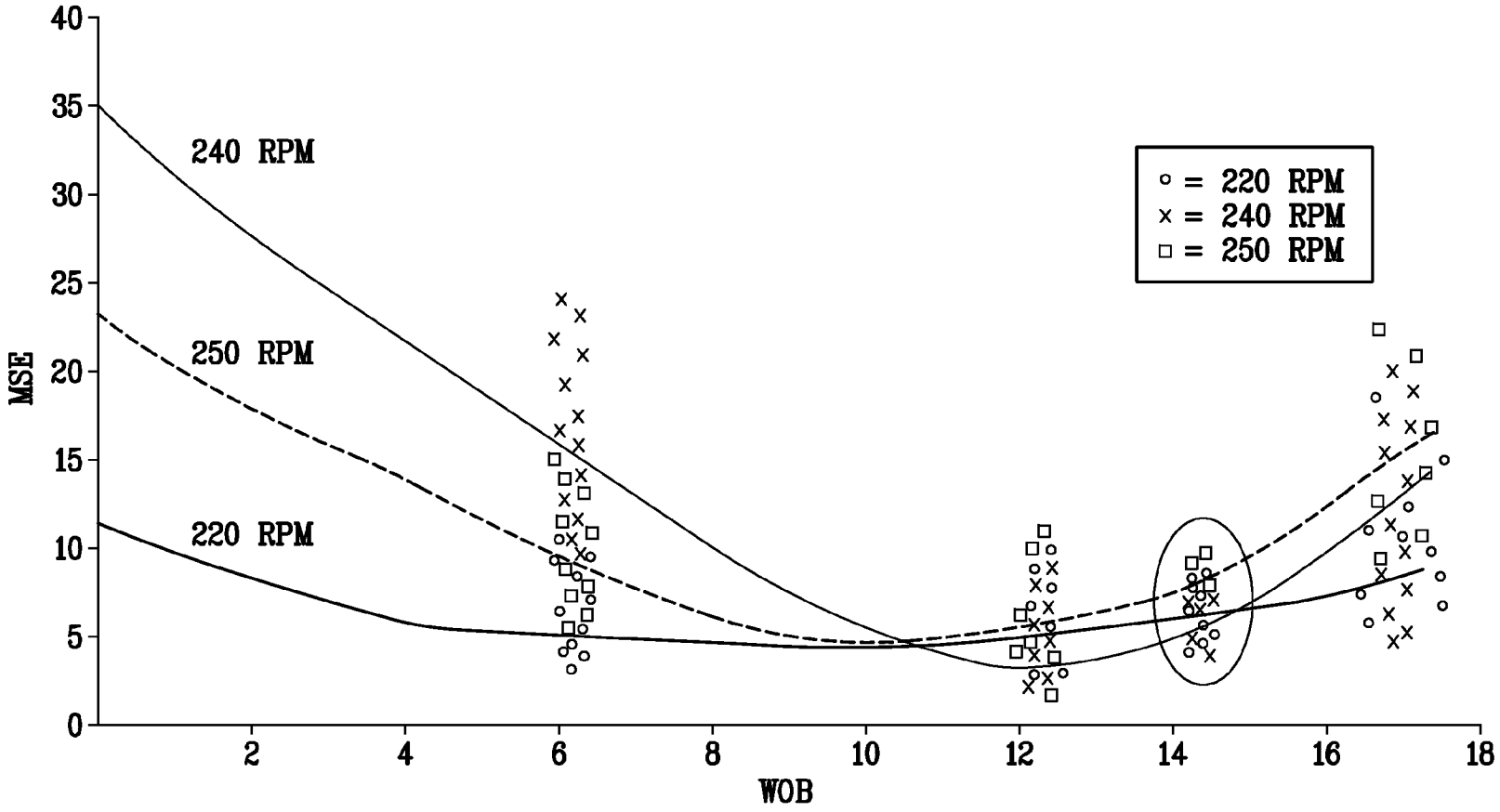
FIG. 2 is a graph of MSE versus WOB, in thousands of pounds, at three drill bit rotary speeds—220 RPM. 240 RPM and 250 RPM. The data is intended for illustrative purposes and is not intended to represent data from an actual drilling operation.

The method of operating a drill string according to the current invention can be illustrated by reference to FIG. 2, which is a graph of MSE, calculated as explained above, at four values of WOB (6,000 lbs, 12,000 lbs, 14,000 lbs and 17,000 lbs) and three drill bit rotary speeds (220 RPM. 240 RPM and 250 RPM). A number of readings are taken at each combination of WOB and RPM. Best fit curves of the data at each RPM are shown on the graph. According to conventional thinking, the operating condition for optimal drilling, based on an assessment of the value of MSE, would be 12,000 lbs WOB and perhaps 240 RPM, since this set of operating conditions yields the lowest value of MSE. However, according to the current invention, operation at these conditions would not be optimal. Rather, a WOB of 14,000 lbs should be used because the scatter in MSE over time is less at this WOB than at 12,000 lbs.

Figure 3:
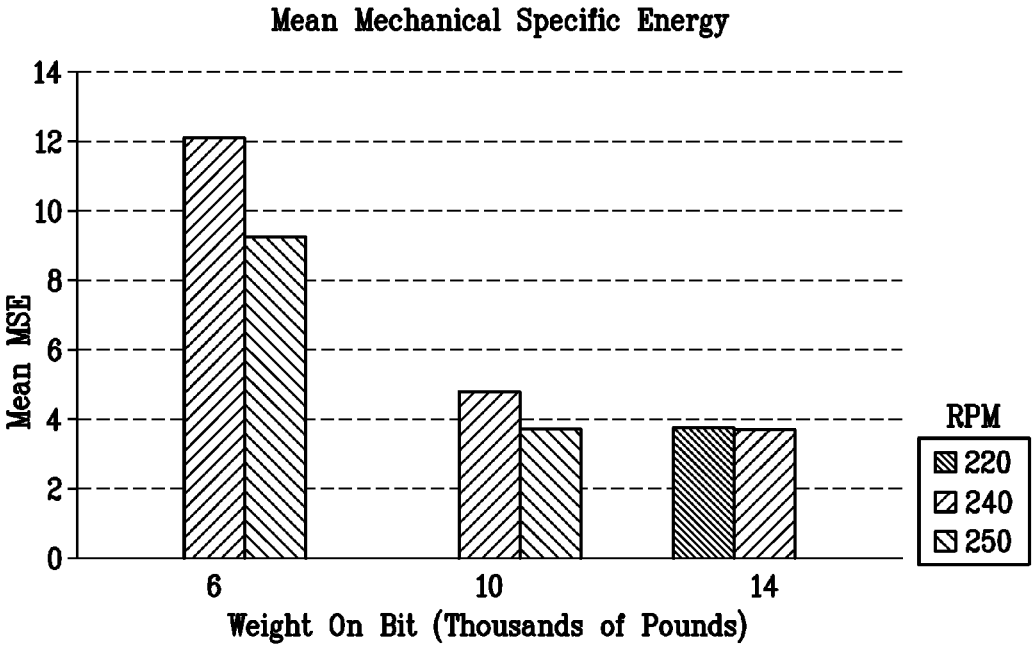
FIG. 3 is a chart, based on actual data from a drilling operation, showing the standard deviation in MSE versus WOB, in thousands of pounds, at drill bit rotary speeds of 220 RPM. 240 RPM and 250 RPM.
Figure 4:
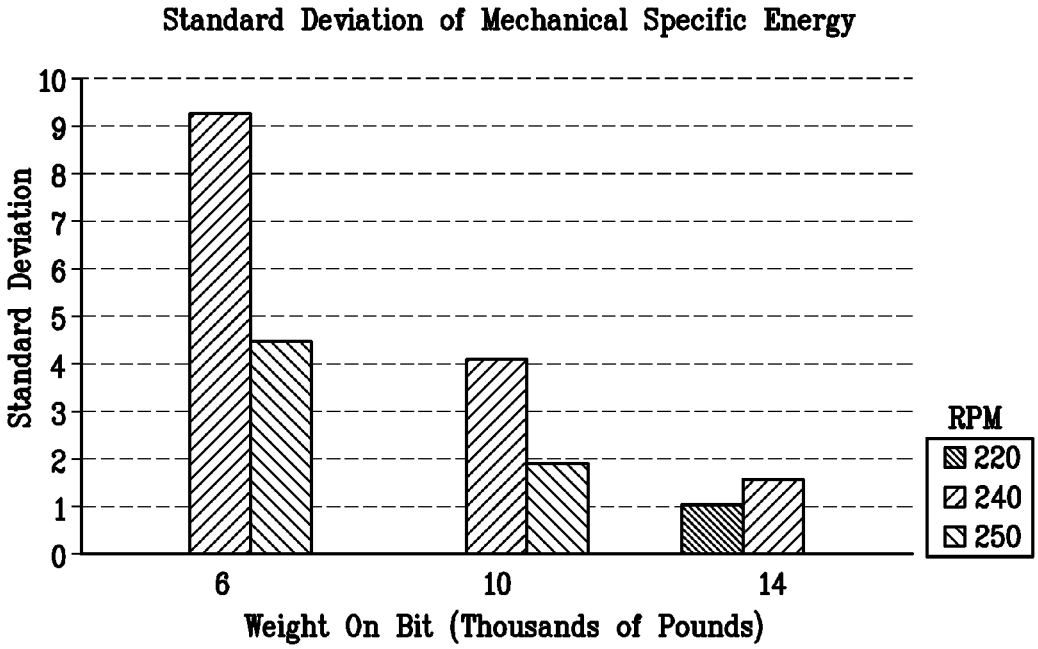
FIG. 4 is a flow chart illustrating a method of optimizing drilling according to the current invention.

FIGS. 3 and 4 show the results of actual data from a drilling operation in which data was taken of TOB and ROP at six different sets of operating conditions—6,000 lbs WOB at 240 RPM and 250 RPM, 10,000 lbs at 240 RPM and 250 RPM, and 14,000 lbs at 220 RPM and 240 RPM. Measurements of WOB, RPM, TOB and ROP were taken every 1 second over a period of about 15 to 30 minutes at each operating condition and average MSE and standard deviation in MSE over 5-10 minute periods were determined. As shown in FIG. 3, the lowest average MSE occurred at 10,000 lbs and 250 RPM, although the average MSE at 14,000 lbs and either 220 RPM and 240 ROM was only slightly higher, indicating that operation at any of these three sets of operating conditions would result in optimal drilling. However, as shown in FIG. 4, consideration of the standard deviation in MSE at each operating condition reveals that the variation in MSE is lowest at 14,000 lbs and 220 RPM, indicating that, according to the current invention, operating at this set of conditions will result in optimal drilling.

Figure 5:
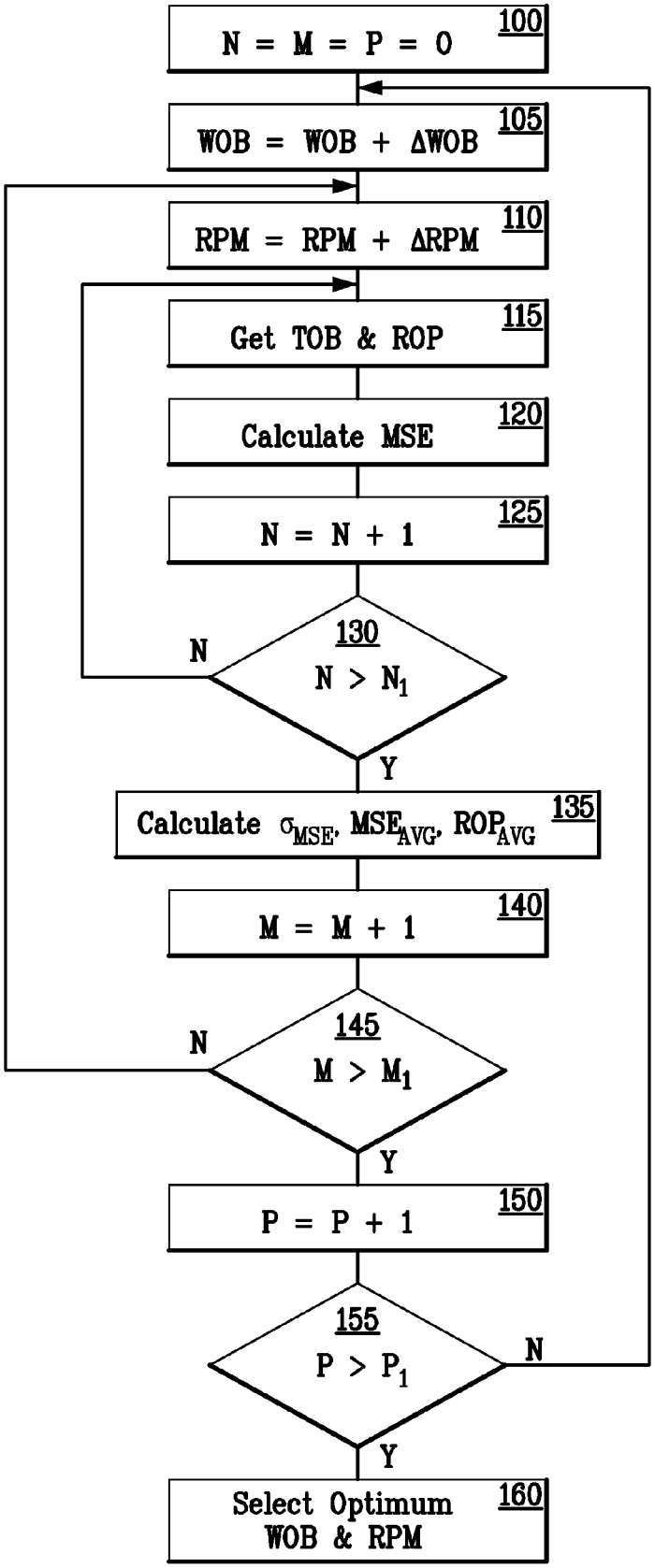
FIG. 5 is a flow chart illustrating a method of monitoring drilling according to the current invention.

FIG. 5 is a flow chart illustrating one embodiment of a method for optimizing drilling according to the current invention. In step 100, values for variables N, M, P and O are set to zero. In step 105, the WOB at which the drill string is operated is increased, as discussed above, by an amount ΔWOB. In step 110, the RPM is increased by an amount ΔRPM. In step 115, the TOB and ROP are measured. In step 120, the MSE is calculated, using the equation discussed above using the measured values of RPM, WOB, TOB and the diameter of the drill bit. Using counter 130, steps 115 and 120 are repeated so that TOB and ROP are measured and MSE is calculated $N_1+1$ different times at the initial values of RPM and WOB. In step 135 the average value of MSE and ROP, as well as the standard deviation in MSE, are determined from the $N_1+1$ sets of data obtained at the initial values of WOB and RPM.

Using counter 145, steps 110 to 135 are repeated for $M_1+1$ different values of RPM. Using counter 150, steps 105 through 135 are repeated for $P_1+1$ values of WOB.

For example, the initial value of WOB might be set at 0 and WOB varied from 2000 lbs to 18,000 lbs in 2000 lb increments ($\Delta$WOB=2000, $P_1$=8) so that data was obtained at nine different WOB's. The initial value of RPM might be set at 200 RPM and RPM varied from 200 RPM to 300 RPM in 20 RPM increments ($\Delta$RPM=20, $M_1$=5) so that data was obtained at six different RPM's at each of the nine WOB's so that the total number of different operating conditions was fifty four. Average values of MSE and ROP and the standard deviation in MSE could be calculated every second for 10 minutes at each set of WOB and RPM ($N_1$=600) so that a total of 32,400 sets of data were obtained.

After values of average ROP and MSE and the standard deviation in MSE have been determined at each set of operating conditions—that is, at each combination of WOB and RPM—the values of WOB and RPM that will yield optimum drilling according to the current invention are selected in step 160. In one embodiment, the selected values of WOB and RPM are those at which the standard deviation in MSE is a minimum. Further, if the standard deviation in MSE at two or more operating points were within a predetermined range, such as within 5% of each other, the set of operating conditions among those conditions that yielded the highest ROP would be selected. If the ROP among the sets of operating conditions at which the standard deviation was within a predetermined range was also within a predetermined range, such as 5% of each other, the set of operating conditions among these conditions that yielded the lowest average MSE is selected. Thus, although the operating condition at which the standard deviation in MSE is clearly lowest is preferably selected, if two or more operating conditions yield essentially the same value of MSE, then ROP is used as the tie breaker. If two or more operating conditions yield essentially the same values of both the standard deviation in MSE and ROP, then average MSE is used as the tie breaker.

In performing steps of the drilling optimization method discussed above, the different operating conditions could be set, and the calculations done, manually by the operator, or some or all of the steps could be programmed in software, using well known techniques, and automatically performed under direction from the processor 18.

Figure 6:
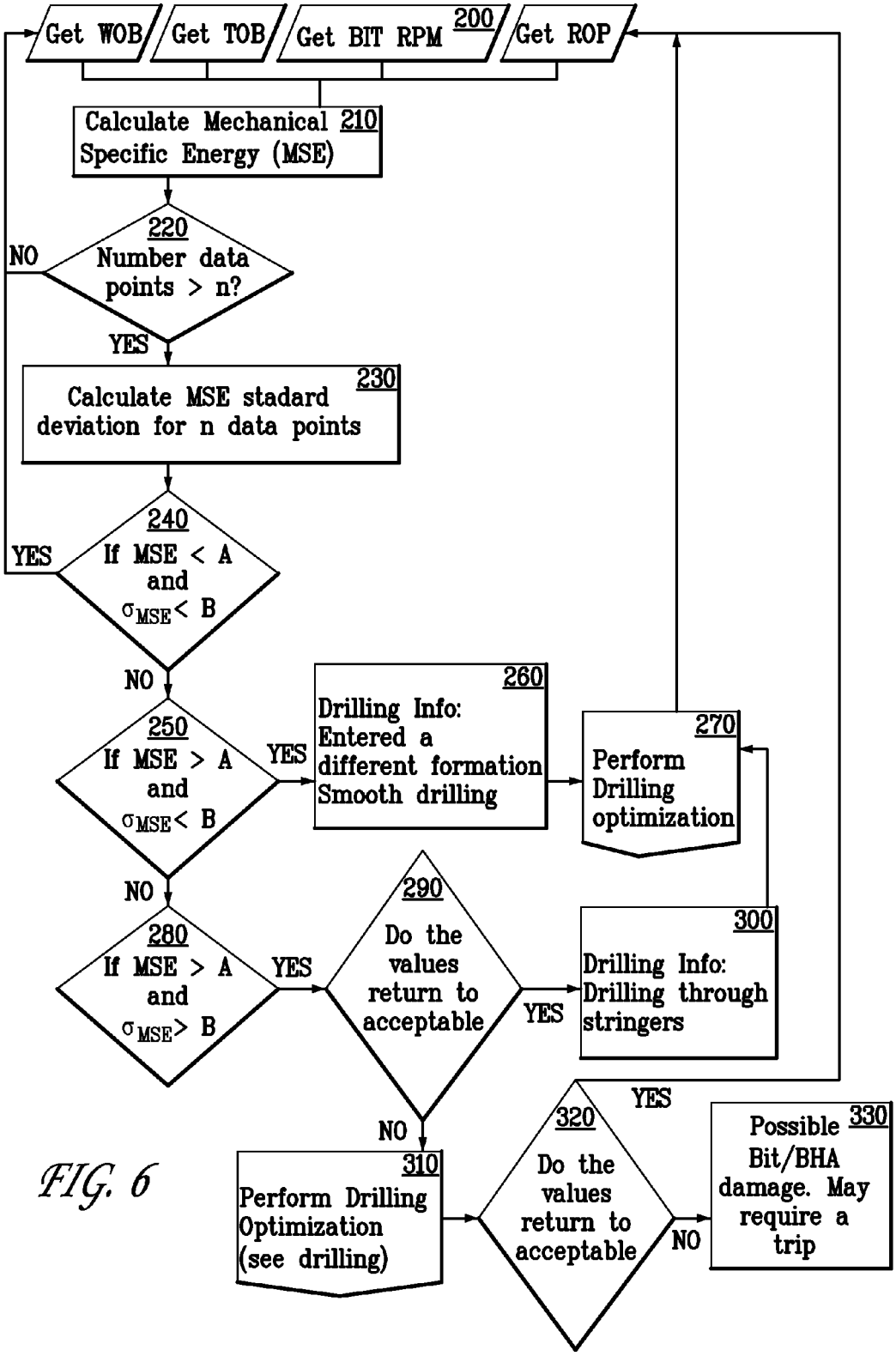
FIG. 6 is a flow chart illustrating a method for monitoring drilling according to the current invention.

FIG. 6 is a flow chart illustrating one embodiment of a method of monitoring drilling according to the current invention. In step 200, values of WOB, TOB, RPM and ROP are obtained, with the values of WOB and RPM having preferably been obtained by the drilling optimization method discussed above. In step 210, the MSE at these operating conditions is determined, using the equation discussed above. These steps are repeated until, in step 220, a determination is made as to whether a sufficient number of data points have been obtained to calculate the standard deviation in MSE. For example, values of MSE might be calculated every one second for 10 minutes and the standard deviation is calculated from these 600 values of MSE. After a sufficient number of data points have been taken the standard deviation in MSE is calculated in step 230, as well as the average value of MSE. In step 240, the average value of MSE is compared to a parameter A and the standard deviation is compared to a second parameter B. No remedial action would be taken if in step 250 both the average MSE was less than A and the standard deviation in MSE were less than B. The parameters A and B may be determined from experience by, for example, using the following equations:

$$A=\mathrm{MSE}_{AVG}+K\times\sigma_{MSE}$$

$$B=L\times\sigma_{MSE}$$

Where K and L are constants selected based on experience in operating the drill string and $\mathrm{MSE}_{AVG}$ and $\sigma_{MSE}$ are the average MSE and standard deviation in MSE obtained at the operating conditions selected based on a drilling optimization test, such as the method discussed above in connection with FIG. 5. For example, K might be set to K=1 and L set to L=3 so that optimum drilling would be deemed to still be obtained if, during normal operation both (i) the average MSE over a predetermined time interval was less than the sum of average value of MSE and the standard deviation in MSE, as obtained at the optimum conditions by the drilling optimization test, and (ii) the standard deviation in MSE over the predetermined time interval was less than three times the standard deviation in MSE obtained at the optimum conditions by the drilling optimization test.

If the conditions in step 240 are not satisfied, then step 250 determines whether, although the average value of MSE exceeded the criteria, the standard deviation in MSE satisfied the criteria. If so, in step 260 the operator is advised that it is likely that drill bit has entered into a formation with different characteristics, for example, from hard rock to softer rock, but that smooth drilling was still being obtained. In step 270, the drilling optimization would be re-run and a new set of optimum drilling conditions (e.g., WOB and RPM) would be obtained and the drilling monitoring re-commenced at the new conditions.

If in step 280 it were determined that both the average value of MSE and the standard deviation in MSE exceeded their criteria—in other words, the average energy used in drilling had significantly increased as well as the variability in the drilling energy—then in step 290 steps 200 to 230 are repeated and a determination is made as to whether the values for average MSE and the standard deviation in MSE have returned to normal—that is, the both the average MSE is again less than A and the standard deviation in MSE is again less than B. If both the average MSE and the standard deviation in MSE now meet criteria in step 290, in other words, step changes are occurring in the drilling so that acceptable drilling is being obtained some of the time but unacceptable drilling at other times, then the operator is notified in step 300 that it is likely that the bit is drilling through stringers in the formation. In step 270, the drilling optimization test is re-run and a new set of optimum drilling conditions (e.g., WOB and RPM) are obtained and the drilling monitoring re-commenced at the new conditions, using the average MSE and standard deviation in MSE determined during the repeat of the drilling test to obtain the criteria used in step 240.

If in step 290, either the average MSE or the standard deviation in MSE still did not meet the criteria—in other words, the repeat of steps 200 to 230 yield values for average MSE and the standard deviation in MSE that still do not meet the criteria—then the drilling optimization test is re-run in step 310 and a new set of optimum drilling conditions (e.g., WOB and RPM) are obtained. In step 320 it is determined whether the average MSE and standard deviation in MSE obtained from the re-run drilling optimization test are sufficiently close to that obtained during the prior drilling optimization test, for example, using the criteria A and B as discussed above for step 240. If the values are sufficiently close, then monitoring is resumed using the average MSE and standard deviation in MSE determined during the repeat of the drilling optimization test in step 310 is used to obtain the criteria applied in step 240.

If either the average MSE or the standard deviation in MSE determined during the repeat of the drilling test in step 310 exceeds the predetermined criteria previously discussed—in other words, the average MSE and standard deviation in MSE are considerably higher than they previously were even at the operating conditions determined to be optimal in the repeat of the drilling optimization test—then in step 330 the operator is advised that the drill bit or bottom hole assembly may have become damaged that the drill string should be removed from the bore hole, referred to as "tripping," to allow inspection of the equipment. Again, the method of monitoring the drilling can be performed manually by the operator, or some or all of the steps could be programmed in software, using well known techniques, and automatically performed under direction of the processor 18.

The methods of the current invention enhance the utilization of MSE by analyzing the data scatter over a given period of time. The data scatter analysis provides a clear insight for identifying the drilling parameters that offer the best drilling efficient over a wide range of drilling conditions. Also, the bit condition can be monitored using MSE. By monitoring the change and scatter over time it can be seen how fast the bit is deteriorating. The information can also be used to take corrective action to extend the bit life. Further, the MSE calculations can be used to see changes in formations at the bit much earlier than with gamma and resistivity tool.

The ideal situation occurs when both the MSE value and the variability in MSE are minimized. When this condition occurs the drilling is optimized and stable, able to withstand a wide range of drilling conditions. Ideally the operator would vary the drilling parameters to identify the condition at which the standard deviation is a minimum and, if the standard deviation is comparable at more than one set of conditions, the operator can determined the conditions as which the value of MSE is a minimum. An increase in MSE, and more significantly, an increase in the variability in MSE, indicates that the drilling conditions downhole have changed and the drilling parameters may need adjusting to once again optimize the drilling.

Tracking MSE also allows the condition of the bit to be monitored. Under normal drilling conditions the MSE will gradually increase to increased depth, increased compressive rock strength and normal bit wear. When the bit is exposed to harsher drilling conditions the slope of the MSE line increases as the bit experiences accelerated wear. As the bit degrades even further the slope continues to increase and becomes more erratic, resulting in an increase in the variability in MSE.

The MSE may also be used to determine the locations of formations well ahead of gamma and resistivity measurements. The MSE value changes with changes in formation strengths. Higher strength formations yield higher MSE values. Additionally, as the bit drills through stringers the MSE values jump around producing large variability in MSE. When the ROP is low, monitoring MSE may indicate the change in formation hours ahead of gamma and resistivity tools.

Although the invention has been described with reference to specific methodologies for optimizing drilling, the invention is applicable to other methodologies based on the teachings herein. For example, operating conditions other than WOB and RPM may be varied to determine the optimum drilling conditions. Although the invention has been described in detail with reference to measurements of MSE, other measures of Specific Energy, such as HMSE, may be used. Accordingly, the present invention may be embodied in other specific forms without departing from the spirit or essential attributes thereof and, accordingly, reference should be made to the appended claims, rather than to the foregoing specification, as indicating the scope of the invention.

What is claimed is:

1. A method of operating a drill string drilling into an earthen formation so as to form a bore hole using a drill bit, comprising the steps of:

(a) operating said drill string at a plurality of different sets of drilling conditions over a period of time during which said drill bit penetrates into said earthen formation, wherein plurality of different sets of drilling conditions include: 1) rotating the drill bit at a plurality of rotational speeds over the period of time, 2) applying a weight to said drill bit at a plurality of weight-on-bit (WOB) values for each of the plurality of rotational speeds over the period of time, and 3) causing a fluid to flow along the drill string at a plurality of flow rates for each combination of the plurality of rotational speeds and the plurality of WOB values;

(b) determining A) a torque applied to said drill bit at each combination of the plurality of rotational speeds, the plurality of WOB values, and the plurality of flow rates over the period of time, and B) a rate of penetration (ROP) of the drill bit into the earthen formation at each combination the plurality of rotational speeds, the plurality of WOB values, and the plurality of flow rates over the period of time;

(c) determining the value of Specific Energy associated with said drilling for each of said combinations of torque and rate of penetration determined in step (b) for each of said plurality of different sets of drilling conditions over the period of time;

(d) determining the variability in said values of Specific Energy determined in step (c) for each of said plurality of different sets of drilling conditions over the period of time;

(e) identifying the set of drilling conditions among said plurality of different sets of drilling conditions for which the variability in Specific Energy was determined in step (d) that yielded the smallest variability in Specific Energy over the period of time; and (f) operating said drill string at said set of drilling conditions identified in step (e) over a subsequent period of time that is subsequent to the period of time.

2. The method according to claim 1, wherein said Specific Energy determined in step (c) comprises the Mechanical Specific Energy.

3. The method according to claim 2, wherein said Mechanical Specific Energy is calculated for each of the plurality of different sets of drilling conditions from the equation:

$$MSE=[(480\times TOB\times RPM)/(D^2\times ROP)]+[(4\times WOB)/(D^2\times\pi)]$$

Where:

MSE=Mechanical Specific Energy
TOB=torque applied to said drill bit, ft-lb
RPM=rotational speed of said drill bit
ROP=rate of penetration of said drill bit, ft/hr
WOB=weight on said drill bit, lb
D=diameter of said drill bit, inches.

4. The method according to claim 1, wherein said variability in Specific Energy determined in step (d) is determined by a step comprising calculating the standard deviation in Specific Energy.

5. The method according to claim 1, wherein said Specific Energy determined in step (c) comprises the Hydro Mechanical Specific Energy.

6. A method of operating a drill string drilling into an earthen formation so as to form a bore hole using a drill bit, comprising the steps of:

(a) operating said drill string at a first set of drilling conditions over a period of time during which said drill bit penetrates into said earthen formation, wherein the first set of drilling conditions include 1) rotating the drill bit at a plurality of rotational speeds over the period of time, 2) applying a weight to said drill bit at a plurality of weight-on-bit (WOB) values for each of the plurality of rotational speeds over the period of time, and 3) causing a fluid to flow along the drill string at a plurality of flow rates for each combination of rotational speeds and the plurality of WOB values;

(b) determining a torque applied to said drill bit and a rate at which said drill bit penetrates (ROP) into said earthen formation for each combination of the plurality of rotational speeds, the plurality of WOB values, and the plurality of flow rates;

(c) determining the value of Specific Energy associated with said drilling from each of said combinations of torque and rates of penetration determined in step (b);

(d) in response to step (c), determining the variability in said values of Specific Energy over the period of time;

(e) comparing said variability in said values of Specific Energy determined in step (d) to a predetermined threshold;

(f) in response to the comparing step (e), if the variability in the values of Specific Energy are within the predetermined threshold, causing the drill string to operate at a second set of drilling conditions, wherein the second set of drilling conditions are the combination of WOB, rotational speed and flow rate that yielded the variability in the values of Specific Energy within the predetermined threshold.

7. The method according to claim 6, wherein said Specific Energy determined in step (c) comprises the Mechanical Specific Energy.

8. The method according to claim 7, wherein said Mechanical Specific Energy is calculated from the equation:

$$MSE=[(480\times TOB\times RPM)/(D^2\times ROP)]+[(4\times WOB)/(D^2\times\pi)]$$

Where:

MSE=Mechanical Specific Energy
TOB=torque applied to said drill bit, ft-lb
RPM=rotational speed of said drill bit
ROP=rate of penetration of said drill bit, ft/hr
WOB=weight on said drill bit, lb
D=diameter of said drill bit, inches.

9. The method according to claim 6, wherein said variability in Specific Energy determined in step (d) is determined by a step comprising calculating the standard deviation in Specific Energy.

10. The method according to claim 6, wherein said Specific Energy determined in step (c) comprises the Hydro Mechanical Specific Energy.

11. The method according to claim 6, further comprising the step of:

identifying as said second set of drilling conditions the set of drilling conditions among said plurality of sets of drilling conditions that yielded the smallest variability in Specific Energy.

12. A method of operating a drill string drilling into an earthen formation so as to form a bore hole using a drill bit, comprising the steps of:

(a) operating said drill string at a plurality of different sets of drilling conditions over a period of time during which said drill bit penetrates into said earthen formation, wherein the plurality of different sets of drilling conditions include 1) rotating the drill bit at a plurality of rotational speeds over the period of time, 2) applying a weight to said drill bit at a plurality of weight-on-bit (WOB) values for each of the plurality of rotational speeds over the period of time, and 3) causing a fluid to flow along the drill string at a plurality of flow rates for each combination of rotational speeds and the plurality of WOB values;

(b) determining the ratio of the energy input into the drilling to the output of the drilling in terms of the rate of penetration of said drill bit into said earthen formation for each combination of the plurality of rotational speeds, the plurality of WOB values, and plurality of flow rates so as to obtain a plurality of ratios of the energy input to the energy output;

(c) determining the variability in said plurality of ratios over the period of time that is determined in step (b) for each of said sets of drilling conditions;

(d) identifying the set of drilling conditions among said plurality of sets of different drilling conditions for which the variability in the plurality of ratios was determined in step (c) is the lowest;

(e) operating said drill string at said set of drilling conditions identified in step (d) that yielded the lowest variability in the plurality of ratios of energy input to energy output.

13. The method according to claim 12, wherein said ratio determined in step (b) comprises the Mechanical Specific Energy associated with said sets of drilling conditions.

* * * * *